United States Patent [19]

Schroeder

[11] Patent Number: 4,786,423

[45] Date of Patent: Nov. 22, 1988

[54] LUBRICANT COMPOSITION CONTAINING TWO HEAVY METAL CONTAINING COMPOUNDS AND A PHOSPHORUS COMPOUND AND PROCESS OF PREPARING THE SAME

[75] Inventor: Hartwig Schroeder, Monchen-Gladbach, Fed. Rep. of Germany

[73] Assignee: ICI Americas Inc., Wilmington, Del.

[21] Appl. No.: 30,090

[22] Filed: Mar. 25, 1987

[30] Foreign Application Priority Data

Mar. 26, 1986 [DE] Fed. Rep. of Germany ..... 3610205

[51] Int. Cl.[4] ..... C10M 135/18; C10M 137/06

[52] U.S. Cl. ..... 252/32.7 E; 252/35; 252/46.4; 252/47; 252/49.8

[58] Field of Search ..... 252/32.7 E, 35, 49.8

[56] References Cited

U.S. PATENT DOCUMENTS

| | | | |
|---|---|---|---|
| 3,361,667 | 1/1968 | Wenborne et al. | 252/32.7 E |
| 3,840,463 | 10/1974 | Froeschmann et al. | 252/42.7 |
| 3,925,213 | 12/1975 | Froeschmann et al. | 252/18 |
| 4,308,154 | 12/1981 | Clasou et al. | 252/32.7 E |
| 4,392,966 | 7/1983 | Schlicht | 252/32.7 E |
| 4,536,308 | 8/1985 | Pehler et al. | 252/32.7 E |
| 4,551,258 | 11/1985 | Ikeda et al. | 252/32.7 E |
| 4,575,431 | 3/1986 | Salentine | 252/32.7 E |
| 4,648,985 | 3/1987 | Thorsell et al. | 252/32.7 E |

FOREIGN PATENT DOCUMENTS

| | | |
|---|---|---|
| 0218086 | 4/1987 | European Pat. Off. . |
| 0220426 | 5/1987 | European Pat. Off. . |

*Primary Examiner*—William R. Dixon, Jr.
*Assistant Examiner*—Ellen McAvoy

[57] ABSTRACT

An improved lubricant is described which contains mineral or synthetic oils and lubricant concentrates, and as additives contains two heavy metal compounds as well as a metal and sulfur-free phosphorus compound. The synthesis of the lubricants is also described.

15 Claims, No Drawings

LUBRICANT COMPOSITION CONTAINING TWO HEAVY METAL CONTAINING COMPOUNDS AND A PHOSPHORUS COMPOUND AND PROCESS OF PREPARING THE SAME

BACKGROUND OF THE INVENTION

The invention concerns a lubricant consisting essentially of mineral or synthetic oils or lubricant concentrate and additives in the form of heavy metal organic compounds and phosphorus compounds.

It is known that to produce a lubricant, mineral or synthetic oils can be provided with additives in order to increase their loadability and oxidation resistance, improve their adherence and limit their heating from friction. Lubricants of the type mentioned above are described in German patent No. 21 08 780. However, it has been found that these known lubricants can still be further improved in terms of abrasion and area pressure.

DETAILED DESCRIPTION OF THE INVENTION

The purpose of the invention is to create a lubricant displaying better abrasion values and permitting a higher area pressure.

This problem is solved according to the invention by the fact that compounds of two heavy metals as well as a metal- and sulfur-free organic phosphorus compound are present as additives.

The lubricant according to the invention can be formulated on the basis of ordinary lubricating oils or lubricant concentrates, e.g. from mineral or synthetic oils such as paraffin oils. Especially suitable are mineral oils having viscosities between 40 and 1500 centistokes at 40° C. Synthetic oils, such as polyalphaolefins and polyglycols and esters, with viscosities between 40 and 1500 centistokes at 40° C. are also especially suitable. The lubricating composition typically contains between 80–97 percent by weight of oil or lubricant concentrate.

Two heavy metal compounds, preferably from the group of compounds of molybdenum, zinc, tungsten, and vanadium are incorporated in the lubricant according to the invention. Preferred combinations are compounds of molybdenum and zinc, tungsten and zinc, and vanadium and zinc.

The anions of the two heavy metal compounds are selected such that the compounds are soluble in the lubricating oil or lubricant concentrate used.

Preferred anions are dithiophosphate, in which the oxygen atoms are preferably esterified with alkyl, aryl, and/or aralkyl groups.

Examples of such alkyl groups are those with 1 to 18 carbon atoms, longer-chained straight or branched alkyl groups with 6 to 18 carbon atoms being preferred. For example, alkyl groups with 8 carbon atoms, such as the 2-ethylhexyl groups, may be used.

Examples of aryl groups that may be used are phenyl groups and naphthyl groups which may be substituted by straight or branched alkyl groups, especially with 1 to 6 carbon atoms.

Examples of aralkyl groups are the above-mentioned alkyl groups which are substituted by the above-mentioned aryl groups.

Specific examples of the heavy metal compounds that may be used are molybdenum and zinc dialkyldithiophosphoric acid esters, e.g. molybdenum and zinc-di-2-ethylhexyl-dithiophosphoric acid esters; a combination of the two latter compounds being especially preferred.

The heavy metal compounds may also be present as a dithiocarbamate; molybdenum dithiocarbamate being especially preferred. A favorable composition is represented by molybdenum dithiocarbamate together with a zinc dialkyldithiophosphate, e.g. zinc-di-2-ethylhexyldithiophosphoric acid ester.

The third component according to the invention, besides the two heavy metal compounds, is an organic phosphorus compound free of metal and sulfur. An organic phosphate, especially a trialkyl or triaryl phosphate is especially well suited, examples of alkyl and aryl groups being the alkyl and aryl groups defined above.

Especially preferred as triaryl phosphates are natural phosphates from the distillation of coal tar, such as trixylylphosphate, tritolylphosphate, tricresylphosphate. Synthetic phosphates, such as alkylphenyl phosphates in which the phenyl radical is substituted by 1 to 3 alkyl groups with 1 to 6 carbon atoms, especially with branched alkyl groups with 3 or 4 carbon atoms, such as the isopropyl groups or sec. or tert.butyl group are especially preferred. An especially well suited example is triisopropylphenyl phosphate.

The above-named three constituents (two heavy metal compounds and metal- and sulfur-free phosphate compounds) are preferably present in weight ratios from 0.1–1.5:0.1–1.5:0.1–1.5, preferably in the weight ratio of about 1:1:1 to each other in the lubricant. Their total weight (sum of the three constituents) in the finished lubricant, preferably amount to 3 to 10%, especially favorable 3.9 to 9.9%, particularly 5.9 to 7.9%, and lies, for example, at about 6.9%.

Especially preferred compositions contain 3.9 to 9.9 percent by weight, especially 6.9 percent by weight, molybdenum-dithiophosphoric acid ester and/or molybdenum-dithiocarbamate, together with zinc-di-2-ethylhexyldithio phosphoric acid ester and triisopropylphenylphosphate; the molybdenum, zinc, and phosphate compounds being present in weight ratios of approximately 1:1:1.

The lubricant according to the invention may, naturally, contain conventional additives. Examples of such additives are ordinary chelate formers, which passivate, for example, undesired copper fractions, for example, as well as other ordinary corrosion inhibitors, adhesion improvers based on polymers, e.g. based on polymethacrylate and corresponding viscosity index improvers, as well as ordinary antirusting agents such as barium dinonylnaphthalene sulfonate, and defoamers.

The lubricant composition of this invention can be synthesized by mixing the individual constituents. For example, the oils are usually heated between room temperature and about 100° C., e.g. about 50° C. for approximately 2 hours. The additives are then sequentially added to the heated oils approximately 20 minutes apart under the referenced elevated temperatures.

EXAMPLES

The following examples serve to illustrate the synthesis and composition of the lubricants according to the invention.

EXAMPLE 1

A lubricant was produced from the following components:

| Component | | |
|---|---|---|
| 1 | Mineral oil component comprising 290.7 kg of HR80 and 624.3 kg of Brightstock 406 | 915.0 kg |
| 2 | Copper passivator (commercial product Reomet 38) | 1.0 kg |
| 3 | Triarylphosphate (isopropyl phenylphosphate) (commercial product Refos 95) | 23.0 kg |
| 4 | Molybdenum-di-2-ethylhexyl-dithiophosphoric acid ester (commercial product Molyvan L) | 23.0 kg |
| 5 | 2-ethylhexyl zinc dithio-phosphate (commercial product RC3180) | 23.0 kg |
| 6 | Polymethacrylate (for lowering the flow point) (commercial product Hitec E 603) | 5.0 kg<br>5.0 kg |
| 7 | Bariumdinonyl naphthalene-sulfonate (corrosion inhibitor, commercial product Na—Sul BSN) | 10.0 kg |
| 8 | DC 200-500 defoamer (commercial product of Dow Corning) | 50.0 g |

The mineral oil component was heated to approximately 50° C. for approximately 2 hours. To the vessel was then added in increments of 20 minutes, Component nos. 2, 3, 4, 5, 6, 7 and 8 respectively. Upon the addition of each reactant, the ingredients were heated to approximately 50° C.

EXAMPLE 2

Example 1 was repeated, but this time the molybdenum-di-2-ethylhexyl-dithiophosphate was replaced by molybdenum-dithiocarbamate.

Measurements with a vibrating friction-abrasion machine (SRV machine) showed that the lubricants according to the invention improved the abrasion values and improved the area pressure.

In addition, sperm oil and terpene are no longer required as additives, which fact makes a not insubstantial contribution to improving the abrasion values and area pressure.

What is claimed is:

1. A lubricant composition comprising:

A. between 80 and 97 percent by weight of a lubricant selected from the group consisting of mineral oil, synthetic oil and a lubricant concentrate;

B. first and second heavy metal containing organic compounds wherein said heavy metal is selected from the group consisting of molybdenum, zinc, tungsten and vanadium; and C. an organic phosphorus compound free of metal and sulfur selected from the group consisting of trialkyl phosphates, triaryl phosphates and alkylphenyl phosphates.

2. A lubricant composition as claimed in claim 1 wherein said organic phosphorus compound is a triarylphosphate.

3. A lubricant composition as claimed in claim 1 wherein the two heavy metal containing organic compounds are dithiophosphates having an oxygen atom esterified with at least one alkyl, aryl or aralkyl group.

4. A lubricant composition as claimed in claim 3 wherein the two heavy metal compounds are molybdenum dithiophosphate and zinc dithiophosphate.

5. A lubricant composition as claimed in claim 1 wherein the first heavy metal containing organic compound, the second heavy metal containing organic compound and organic phosphorus compound are in the weight ratio of 0.5–1.5: 0.5–1.5: 0.5–1.5.

6. A lubricant composition as claimed in claim 5 wherein said weight ratio is about 1:1:1.

7. A lubricant composition as claimed in claim 5 wherein the total weight of said first heavy metal containing organic compound, second heavy metal containing organic compound and organic phosphorus compound in said lubricant composition is between 3 to 10 percent by weight.

8. A lubricant composition as claimed in claim 1 wherein at least one of the heavy metal containing organic compounds is a dithiocarbamate.

9. A lubricant composition as claimed in claim 8 wherein at least one of the heavy metal containing organic compounds is molybdenum dithiocarbamate.

10. A lubricant composition as claimed in claim 9 wherein the two heavy metal containing organic compounds are molybdenum dithiocarbamate and zinc dithiophosphate.

11. A process for producing a lubricant composition comprising 80 to 97 weight percent by weight of a lubricant selected from the group consisting of a mineral oil, synthetic oil, and a lubricant concentrate which comprises heating in a vessel said lubricant to a temperature between 25° C. and 100° C., stirring into said vessel (i.) two heavy metal containing organic compounds wherein said heavy metal is selected from the group consisting of molybdenum, zinc, tungstens and vanadium and (ii.) an organic phosphorus compound free of metal and sulfur selected from the group consisting of trialkyl phosphates, triaryl phosphates and alkylphenyl phosphates until dissolution is achieved.

12. A lubricant composition as claimed in claim 1 wherein said mineral oil or synthetic oil is paraffin oil.

13. A lubricant composition as claimed in claim 1 wherein said mineral oil has a viscosity between 40 and 1500 centistokes at 40° C.

14. A lubricant composition as claimed in claim 1 wherein said synthetic oil is a polyalphaolefin, polyglycol or polyglycol ester.

15. A lubricant composition as claimed in claim 14 wherein the viscosity of said synthetic oil is between 40 to 1500 centistokes at 40° C.

* * * * *